US006467928B2

(12) United States Patent
Crelin

(10) Patent No.: US 6,467,928 B2
(45) Date of Patent: Oct. 22, 2002

(54) LIGHT FIXTURE AND MOUNTING SYSTEM

(75) Inventor: Robert Crelin, Branford, CT (US)

(73) Assignee: Lighting by Branford, LLC, Guilford, CT (US)

( * ) Notice: Subject to any disclaimer, the term of this patent is extended or adjusted under 35 U.S.C. 154(b) by 0 days.

(21) Appl. No.: 09/782,935

(22) Filed: Feb. 14, 2001

(65) Prior Publication Data

US 2001/0033487 A1 Oct. 25, 2001

Related U.S. Application Data

(60) Provisional application No. 60/182,678, filed on Feb. 15, 2000.

(51) Int. Cl.[7] ..... F21S 3/00

(52) U.S. Cl. ..... 362/147; 362/370; 362/432; 362/375

(58) Field of Search ..... 362/147, 368, 362/370, 371, 432, 374, 375

(56) References Cited

U.S. PATENT DOCUMENTS

| | | | | | |
|---|---|---|---|---|---|
| 999,465 | A | | 8/1911 | Pritchard | |
| 1,029,557 | A | | 6/1912 | Palmer et al. | |
| 1,469,587 | A | | 10/1923 | Newton | |
| RE22,037 | E | | 2/1942 | Markel et al. | |
| 2,978,573 | A | | 4/1961 | Kalbrunner | |
| 3,429,538 | A | | 2/1969 | Natale | |
| 4,217,629 | A | * | 8/1980 | Russell | 362/370 |
| 4,245,284 | A | * | 1/1981 | Moore et al. | 362/432 |
| 4,300,190 | A | | 11/1981 | Mershon | |
| 4,303,968 | A | | 12/1981 | Goralnik | |
| 4,317,164 | A | | 2/1982 | Karaktin | |
| 4,384,316 | A | | 5/1983 | de Vos et al. | |
| 4,450,512 | A | | 5/1984 | Kristofek | |
| 4,554,621 | A | | 11/1985 | Corrigan | |
| 4,691,267 | A | | 9/1987 | Giesberg | |
| 4,747,025 | A | * | 5/1988 | Barton | 362/147 |
| 4,888,669 | A | | 12/1989 | Hanson | |
| 5,001,611 | A | | 3/1991 | Beachy et al. | |
| 5,122,936 | A | | 6/1992 | Guthrie | |
| 5,309,334 | A | | 5/1994 | Willison | |
| 5,349,134 | A | | 9/1994 | Russell | |
| 5,526,251 | A | | 6/1996 | Andre et al. | |
| 5,613,766 | A | * | 3/1997 | Raouf | 362/287 |
| 5,655,833 | A | * | 8/1997 | Raczynski | 362/432 |
| 5,713,657 | A | | 2/1998 | Dearborn | |
| 6,132,065 | A | * | 10/2000 | Wedell et al. | 362/267 |
| 6,135,624 | A | * | 10/2000 | Masters et al. | 362/432 |

* cited by examiner

*Primary Examiner*—Thomas M. Sember
(74) *Attorney, Agent, or Firm*—St. Onge Steward Johnston & Reens LLC

(57) ABSTRACT

A light fixture is provided having a mounting bracket and a light housing secured to the bracket. The bracket further includes a securing member for securing the bracket to a fixed surface, an extension projecting from a surface of the securing member, and a housing support placed at the end of the extension for supporting the light housing. The light housing has a receiver for placing over and mating around the housing support when the housing support is slid inside the receiver. To position the light housing on center with the bracket, a locating member connected to the bracket mates with and guides the light housing into a centered position. The light housing further includes a door and, when in a closed position, the door has a tab extending underneath the bracket such that the light housing cannot be removed from the bracket without opening the door.

21 Claims, 9 Drawing Sheets

LIGHT FIXTURE AND MOUNTING SYSTEM

PRIOR APPLICATION

This application claims priority benefits under 35 U.S.C. §119(e) of U.S. Provisional Patent Application Ser. No. 60/182,678 filed Feb. 15, 2000.

FIELD OF THE INVENTION

The invention relates to a light fixture for providing light and, more particularly, a light fixture having a mounting bracket, adaptable to a variety of angled surfaces, and a light source centered and fastened to the mounting bracket.

BACKGROUND OF THE INVENTION

Known light fixtures include permanently fixed and removable apparatuses. These apparatuses also include elements that are welded and/or fastened together. Fixtures having separable pieces generally include a wall or surface mounted bracket for providing a base upon which to secure the light. These fixtures also generally include a light source and fasteners for securing the light source to the base.

U.S. Pat. No. 3,429,538 to Natale ("'538 patent") discloses a wall mount having a perpendicularly extending member and a light source with a hook for hanging the light source from the end of the member. The light fixture does not provide a structure for centering the light source on the bracket and the bracket is not disclosed to be mountable to any surface other than a vertical surface, such as a wall. Also, the '538 patent does not disclose that the light source is fastened or secured to the bracket.

U.S. Pat. No. 4,888,669 to Hanson ("'669 patent") discloses a light fixture having a wall mount, where the wall mount is a pair of brackets that are fastened independently from one another to a fixed surface. The pair is then inserted into a light housing having a pair of mating receivers and a light source.

U.S. Pat. No. 4,317,164 to Karaktin ("'164 patent") discloses a light fixture having a base being fixed to a generally horizontal surface and a bracket connected to the base for supporting a light source whose connection with the bracket is hidden.

U.S. Pat. No. 22,037 to Markel et al. ("'037 patent") and U.S. Pat. No. 1,469,587 to Newton ("'587 patent") both disclose a wall mounted light fixture having a cantilevered member for supporting a light source.

However, neither the '669 nor '164 patents disclose structure for centering or positioning the light source. Also, neither the '037, '587, '164, nor '669 patent discloses a door for covering the light source or a bracket adaptable to a variety of angled surfaces to increase flexibility and installation. Moreover, no reference disclosed a structure that simultaneously keeps a door to the light source in a closed position and secures the light source to the mounting bracket.

What is desired, therefore, is a light fixture having structure for centering the light source on the mounting bracket. What is also desired is a light fixture that has the light housing secured to the mounting bracket. What is further desired is a light fixture permitting both hands to be free from supporting a part of the light fixture in order to facilitate wiring the apparatus. What is still further desired is a bracket adaptable to variably angled mounting surfaces.

SUMMARY OF THE INVENTION

Accordingly, it is an object of the invention to provide a light fixture that mounts the light housing on center with the mounting bracket.

It is another object to provide a light fixture that mounts to a variety of angled surfaces.

It is yet another object of the invention to secure the light housing to the bracket while simultaneously keeping a door in a closed position.

It is a further object of the invention to provide a light fixture that does not require a user to support any part of the fixture once a light source is attached to a mounting bracket, thereby freeing both hands to electrically wire the invention.

These and other objects of the invention are provided by a light fixture having a mounting bracket and a light housing secured to the bracket. The bracket further includes a securing member for securing the bracket to a fixed surface, such as a wall. The bracket also includes an extension projecting from a surface of the securing member in a generally perpendicular direction and having a cantilevered end. The extension operates to support a housing support placed at the cantilevered end and for spacing apart the housing support from the securing member. The housing support, upon which the light housing is secured, includes a pair of inwardly tapered arms extending in a generally vertical direction upwardly from the cantilevered end of the extension. The light housing has a receiver for placing over and mating around the housing support when the arms are slid inside the receiver. To position the light housing on the bracket, a locating member connected to the bracket mates with and guides the light housing into a centered position. The light housing further includes a lighting chamber for covering and protecting a light source and a door permitting access to the light source. When in a closed position, the door has, in at least one localized area, a projecting portion extending underneath the bracket such that the light housing cannot be removed from the bracket without opening the door.

In another embodiment, the light fixture may further be mounted from a horizontal surface, such as a ceiling or overhang. The extension is generally L shaped, whereby the housing support is placed at the cantilevered end for maintaining the light housing in a horizontal position.

The portion projecting underneath the bracket may further be a tab or edge of the door. In order to provide a more secure connection between the light housing and bracket, the housing support fits snugly within the receiver. A snug fit is provided where an outer dimension of the housing support is slightly smaller than an inner dimension of the receiver. The tighter, or snugger, the fit, the more secure the light housing is mounted to the bracket.

The locating member guides and centers the light housing by mating with a recess in the receiver. The locating member is triangular shaped and mates with a similarly triangular shaped recess, whereby a point of the triangle is located in a center position.

In order to keep the door in a closed position, a securing mechanism, such as a fastener, bolt, or adhesive, may be used.

The securing member may further include a flange with a plurality of holes, thereby permitting a fastener, such as a bolt, to pass through the flange and attach to a fixed surface.

To provide power to the light source, electrical wires from a source of electricity are connection with the light source. The wires from the source of electricity may, therefore, be carried through the light fixture via a channel, or conduit, and into an electrical box to link with the wires to the light source. The electrical box being defined by the pair of inwardly tapered arms of the housing support and the locating member. The electrical box may further include an aperture for dissipating heat.

In another embodiment of the invention, a bracket is provided having a securing mechanism for simultaneously securing the door in a closed position and for securing the light housing to the bracket. The securing mechanism may be a threaded hole for receiving a fastener that fastens through the door and to the threaded hole. Similarly to the portion of door extending underneath the bracket when in a closed position, the light housing is secured to the bracket when the door is fastened in a closed position to the securing mechanism.

The bracket may further include a second securing mechanism or uses an existing securing mechanism for connecting a motion sensor or secondary light source, such as a flood light. In this embodiment, the second securing mechanism may also be a threaded hole, to which a fastener, such as a bolt, for the motion sensor or secondary light source attaches.

In another embodiment, an optional support is provided to support an optional secondary light source. The support includes a receiver having a front side, a back side, a left side, and a right side, thereby defining a receptacle. The support also includes a recess for positioning the support and the recess, which may be triangular, extends upwardly from the bottom of the back side. The support further includes a securing mechanism placed on the front side to which the secondary light source is secured and a locking mechanism placed on the front side for securing the support to the mounting bracket described above.

The locking mechanism is a spring loaded L shaped lever that is continuously in a closed position for securing the support to the bracket. Releasing the locking mechanism requires a user to compress the spring, thereby pivoting the locking mechanism.

The front side of the support may further include three angled sides resembling a geometry for a bay window. Moreover, each of the three sides of the front side may further have a securing mechanism, such as a threaded hole. Such an arrangement permits three angles in which to project light when the secondary light source is attached. The secondary light source may be a flood light.

The invention and its particular features and advantages will become more apparent from the following detailed description considered with reference to the accompanying drawings.

DETAILED DESCRIPTION OF THE DRAWINGS

Figure 1:
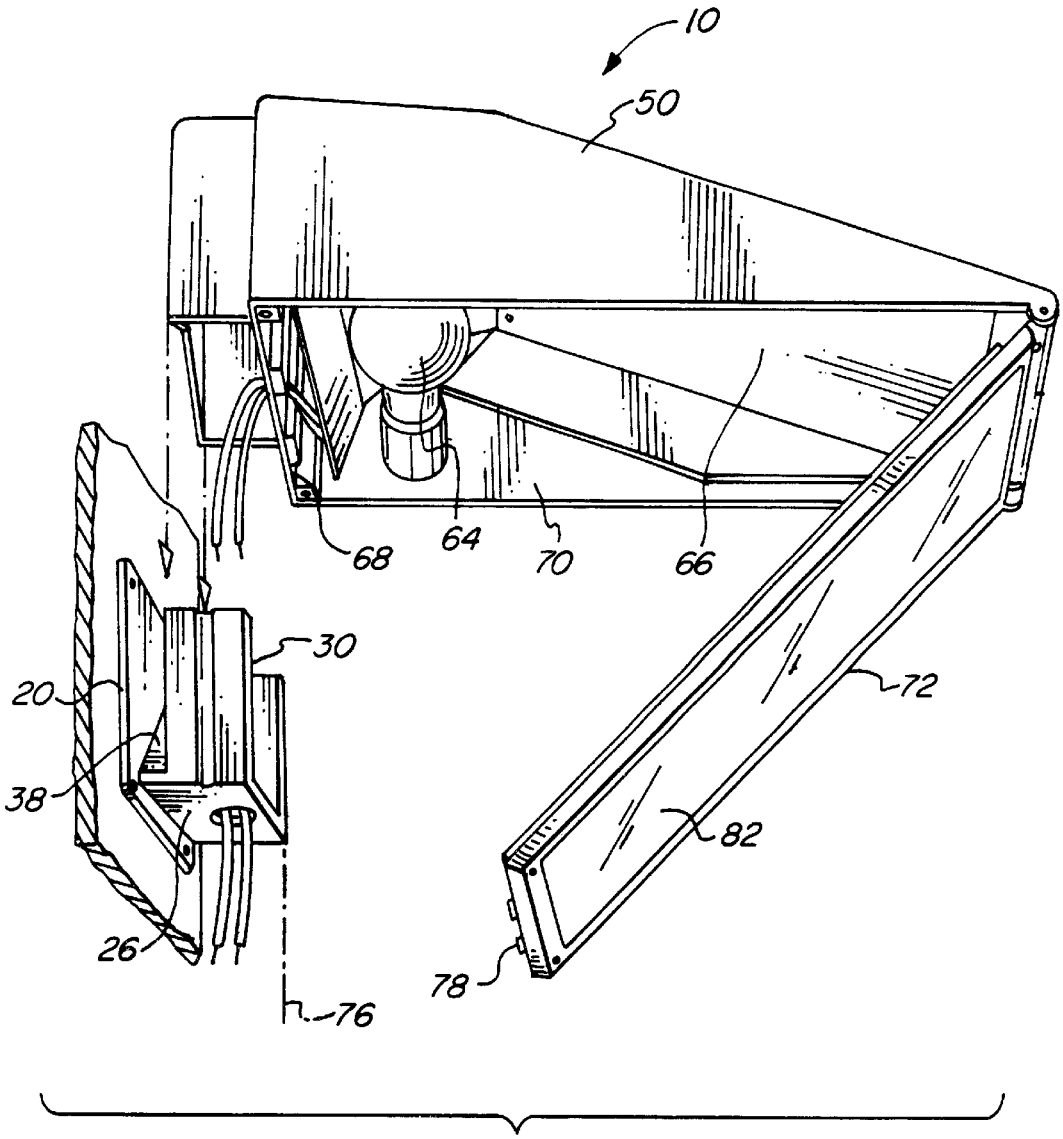
FIG. 1 depicts the light fixture in accordance with the invention.

FIG. 1 depicts the light fixture in accordance with the invention. Light fixture 10 includes mounting bracket 20 for mounting light fixture 10 to a surface and light housing 50 for providing illumination.

Bracket 20, more particularly depicted in FIGS. 3*a*, 3*b*, 3*c*, and 3*d*, further includes securing member 22, which is a part of bracket 20 that mounts directly to the fixed surface, thereby securing light fixture 10. Securing member 22 is a flange, or flat metal plate, having at least one aperture for permitting a fastener, such as a rivet or bolt, to fasten bracket 20. However, securing member 22 may be a lip of bracket 20 or any structure permitting a fastener to pass through, thereby attaching securing member 22 to the fixed surface. The fixed surface includes a wall or side of a house or building. The fixed surface may also include a spacer in between and in contact with bracket 20 and a wall. The spacer is particularly advantageous for uneven wall surfaces or wall surfaces not generally vertical, whereby the spacer provides a generally vertical surface to which securing member 22 is fixed.

Referring to FIGS. 3*a*, 3*b*, 3*c*, and 3*d*, securing member 22 includes a surface 24, from which extension 26 projects in a generally perpendicular direction.Extension 26, therefore, has one fixedend, the end fixed to surface 24, and one cantilevered end 28. Extension 26 operates as a spacer for spacing apart housing support 30, placed at cantilevered end 28, and surface 24. Extension 26 also operates as a support upon which housing support 30 is placed. Extension 26 may be a flat plate, rod, or any device projecting from surface 24 and for supporting housing support 30.

In certain embodiments, extension 26 is welded to securing member 22. In certain other embodiments, extension 26 is adhered to securing member 22. In still certain other embodiments, extension 26 is bolted or fastened to securing member 22. The way in which extension 26 is attached to securing member 22 is not germane to the invention and may use any known or novel manners for joining extension 26 to surface 24 of securing member 22.

Referring to FIGS. 3*a*, 3*b*, 3*c*, and 3*d*, housing support 30 is a pair of inwardly tapered arms 32 extending in a generally vertical and upward direction from extension 26. Specifically, housing support 30 extends in a generally perpendicular direction from cantilevered end 28. Arms 32 are closer to one another at their upper ends 36 than at their lower ends 34. This tapering facilitates sliding light housing 50 on arms 32 and, more particularly, sliding housing support 30 inside light housing 50.

Figure 3A:
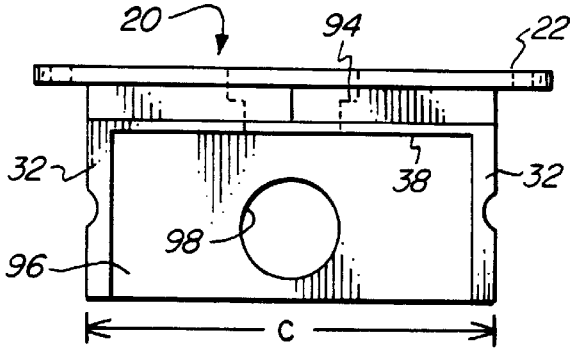
FIG. 3*a* depicts a top view of the bracket in accordance with the invention.
Figure 3B:
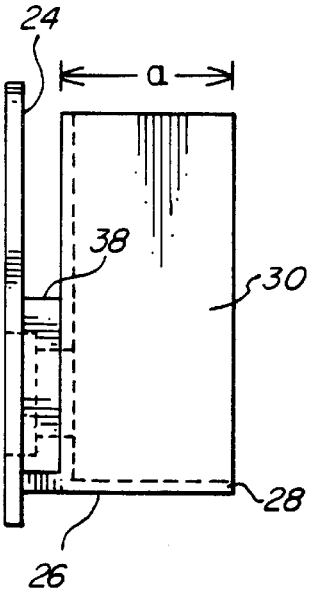
FIG. 3*b* depicts a side view of the bracket in accordance with the invention.
Figure 3C:
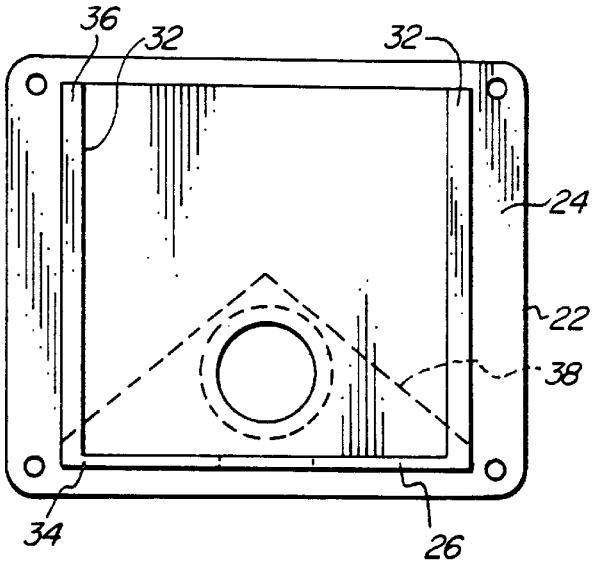
FIG. 3*c* depicts a front view of the bracket in accordance with the invention.
Figure 4A:
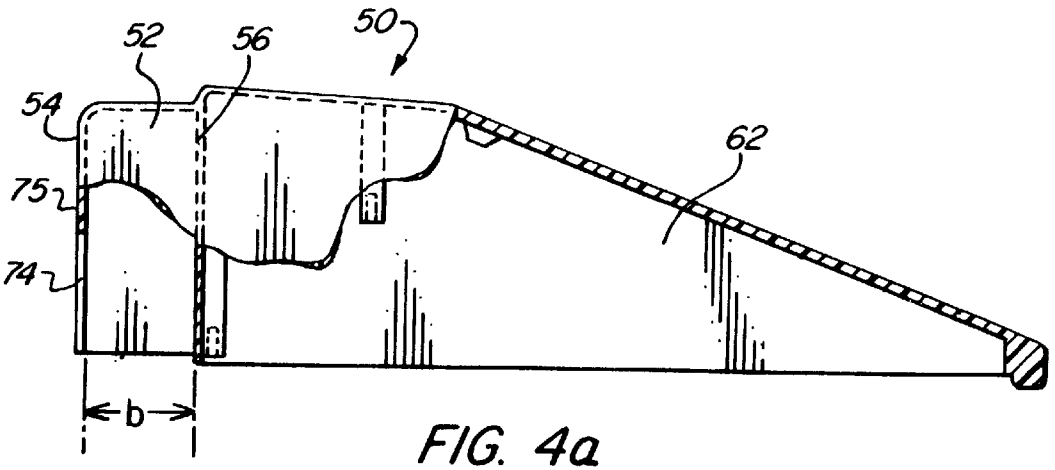
FIG. 4*a* depicts a left side view of the light housing in accordance with the invention.
Figure 4B:
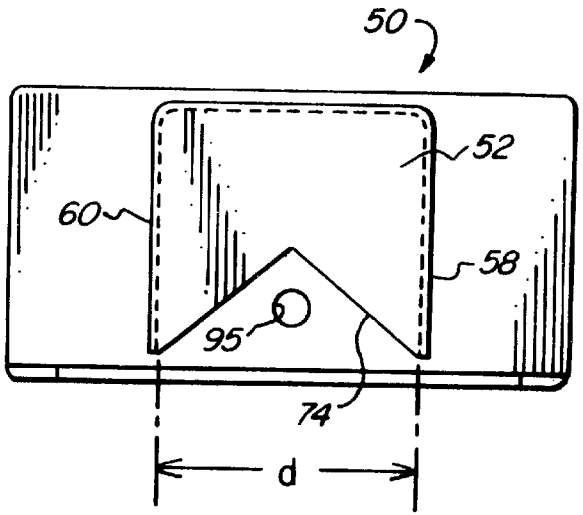
FIG. 4*b* depicts a rear view of the light housing in accordance with the invention.

Referring to FIGS. 4*a* and 4*b*, light housing 50 includes receiver 52 for mating around and forming a snug fit with housing support 30. Receiver 52 forms a snug fit around housing support 30. The snug fit is most advantageous between dimension a, as depicted in FIG. 3*b*, of housing support 30 and dimension b of receiver 52, shown more accurately in FIG. 4*a*. Dimension b is the inner dimension between back side 54 and front side 56 and is always larger than dimension a, the outer dimension of arms 32, so than housing support 30 will fit within receiver 52 and, preferably, dimension b ranges from several fractions of an inch to several thousandths of an inch greater than dimension a. The closer the tolerance and smaller the difference between dimension a and b, the tighter the fit and this desirably provides a more securely positioned light housing 50. It should be known that a snug fit between housing support 30 and receiver 52 is not required for the invention to function properly. Without a snug fit, housing support 30 maintains sufficient support upon which light housing 50 is placed, but light housing 50 may not be as securely positioned and there may be play, or movement, between light housing 50 and bracket 20.

To position light housing 50 generally on center with respect to bracket 20, locating member 38 operates as a guide to automatically center light housing 50 when housing support 30 is placed inside receiver 52. In certain other embodiments and in the absence of locating member 38, dimension c of housing support 30, as shown in FIG. 3*a*, and dimension d, an inner dimension between left t side 58 and right side 60 of receiver 52 and shown more accurately in FIG. 4*b*, will have a snug fit with one another, including all the limitations as mentioned above. However, as depicted in FIG. 1 and because of locating member 38, dimension c and dimension d need not have such critically close tolerances, or a snug fit with one another.

Figure 2A:
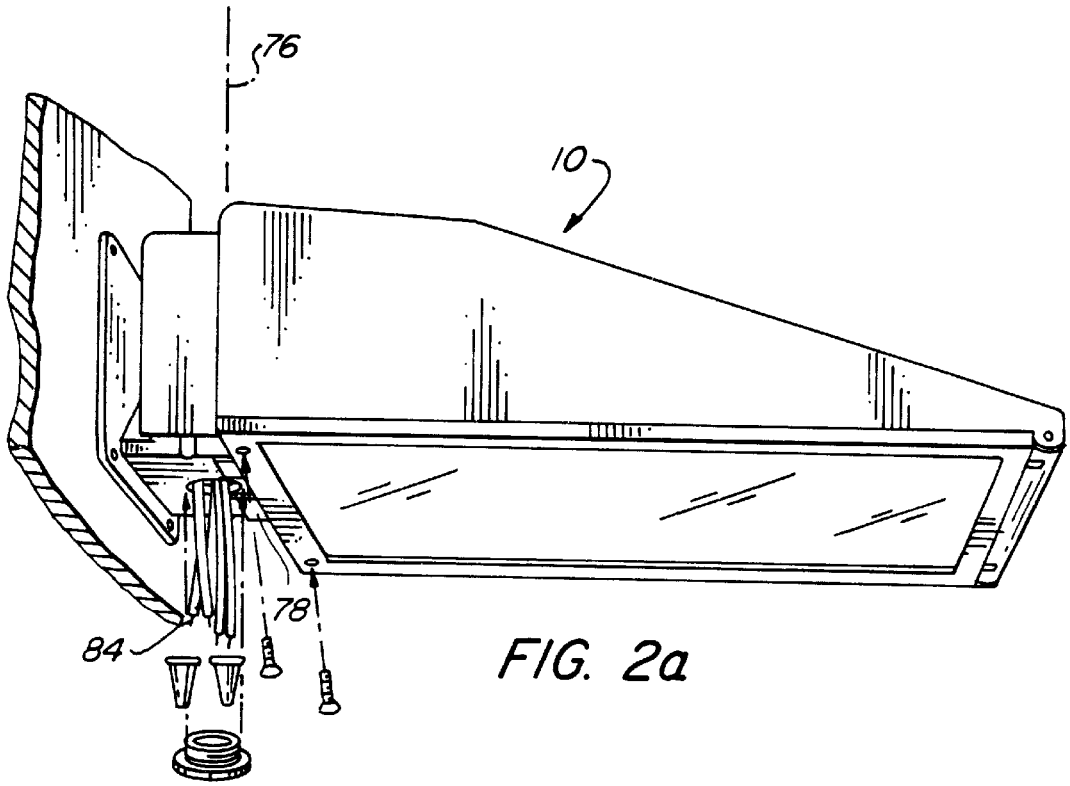
FIG. 2*a* depicts the light fixture in a closed position and having electrical wires protruding from an access hole.
Figure 2B:
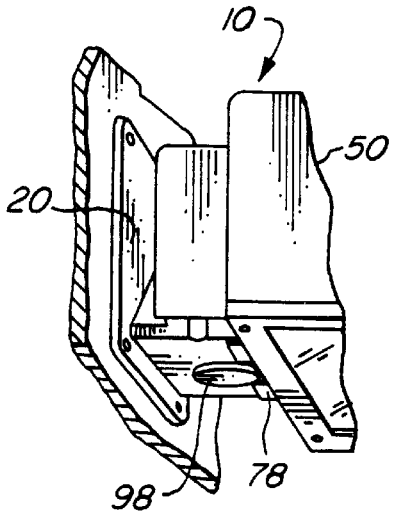
FIG. 2*b* depicts the light fixture in a closed position and having the electrical wires placed up into the electrical box.

Locating member 38, as depicted in FIGS. 1, 3*b*, 3*c*, and 3*d*, is a triangular shaped metal plate in between housing support 30 and surface 24. A triangular plate, like inwardly tapered arms 32, facilitates placing light housing 50. In addition, the triangular shape simultaneously and automatically guides light housing 50 to a desired center position with respect to bracket 20 as locating member 38 is placed further within triangular recess 74, located in a wall 75 of receiver 52 and mating with locating member 38. Recess 74 is more particularly depicted in FIG. 4*b*. As receiver 52 is placed thereon housing support 30, thereby forming a snug fit, recess 74 is simultaneously placed thereon locating member 38. This is shown in FIGS. 1, 2*a*, and 2*b*. Similar to housing support 30, locating member 38 extends in a generally vertical direction upwardly from extension 26.

Figure 4C:
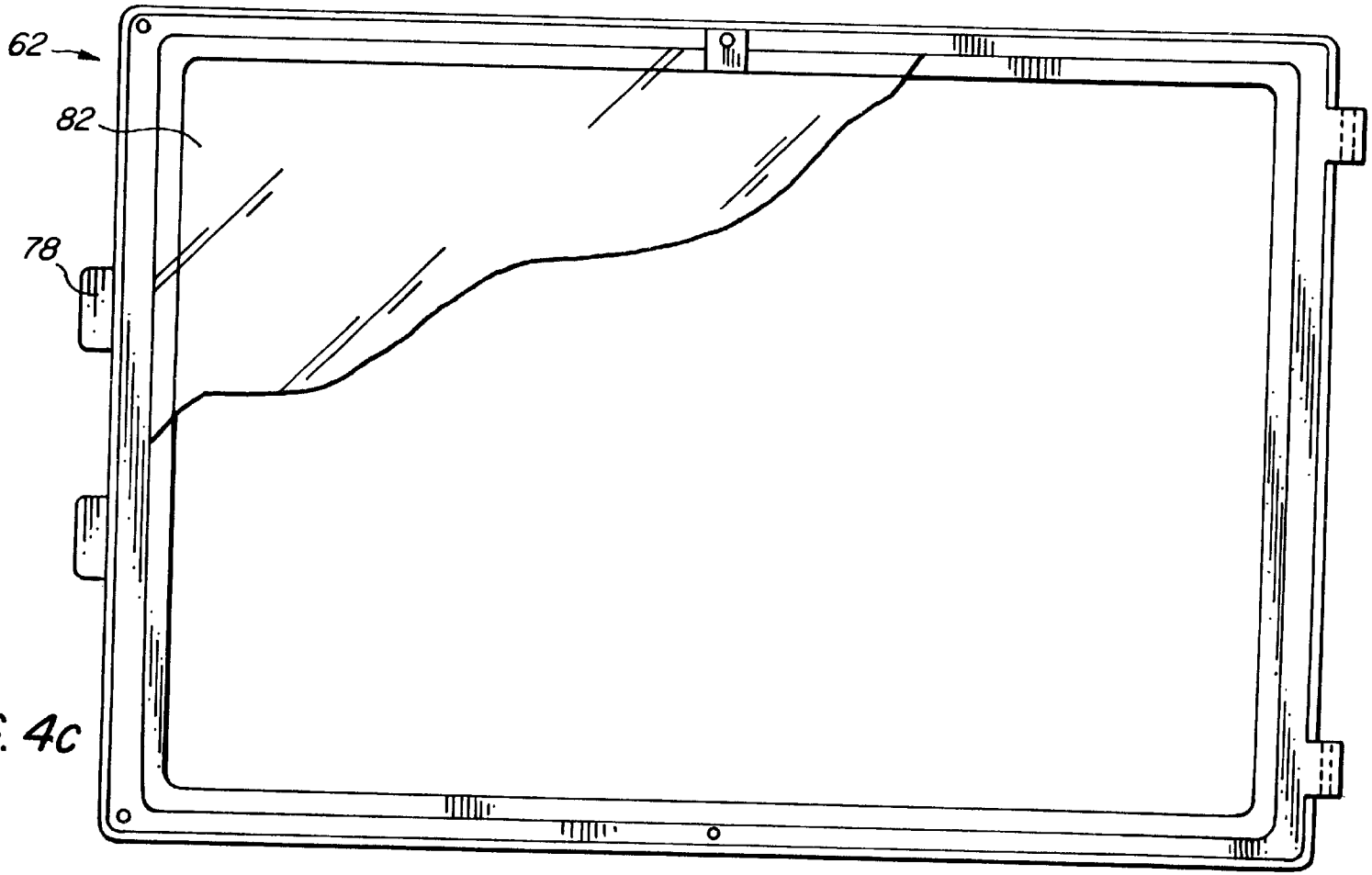
FIG. 4*c* depicts a bottom view of the lighting chamber and door in accordance with the invention.

Referring to FIGS. 4*a* and 4*c*, light housing 50 further includes lighting chamber 62. Lighting chamber 62 is a covering for a light source 64 but does not include receiver 52. Light source 64 includes known or novel sources of light, such as a light bulb or fluorescent light. Lighting chamber 62 helps protect light source 64 from physical shock and breakage. As shown in FIG. 1 and in certain embodiments, lighting chamber 62 includes top surface 66, which functions as a reflector, back surface 68, and at least one side surface 70, thereby defining a cover closed on all sides except one, namely leaving a bottom surface open. In certain other embodiments, lighting chamber 62 will have some other surface open, such as top surface 66, back surface 68, or at least one side surface 70.

Figure 4D:
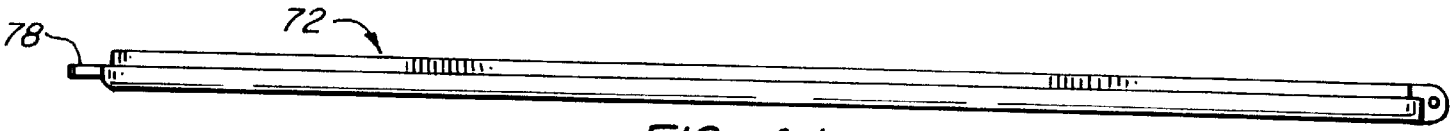
FIG. 4*d* depicts a left side view of the door in accordance with the invention.

To close lighting chamber 62, thereby surrounding light source 64, light housing 50 includes door 72. As shown in FIGS. 1, 4*c*, and 4*d*, door 72 is hingedly attached to an edge of lighting chamber 62 and, in an open position as shown in FIG. 1, permits access to light source 64. The manners in which door 72 is attached to lighting chamber 62, whether in an open position or closed position, as shown in FIGS. 2*a* and 2*b*, includes all known or novel methods for attachment, including fastening using fasteners and/or adhering using an adhesive.

However, when door 72 is in a closed position, using any known or novel methods for attachment, a portion 78 of door 72 extends beyond a vertical plane 76 of housing support 30. Vertical plane is defined to be any part of bracket 20 having a vertical dimension. In FIG. 1, housing support 30 and/or extension 26 define vertical plane 76. As shown in FIG. 2*b*, portion 78 prevents light housing 50 from being removed from bracket 20 in an upwardly direction when door 72 is in a closed position because portion 78 cannot be lifted without coming in contact with bracket 20. Portion 78 may be a tab, an edge of door 72, or any structure connected to door 72 and projecting beyond a vertical plane of bracket 20.

Door 72 further includes window 82 through which light from light source 64 emanates. Window 82 may merely be an opening or be a transparent material, such as glass, lexan, or plastic. Window 82 is more particularly depicted in FIG. 4*c*.

Figure 3D:
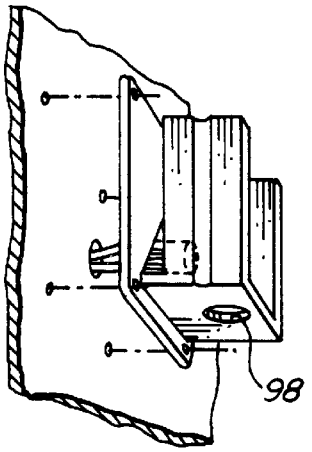
FIG. 3*d* depicts an isometric view of the bracket in accordance with the invention.

Referring to FIGS. 2*a*, 3*a*, and 3*d*, arms 32 and locating member 38 define an electrical box 96 for containing electrical wires 84. Electrical wires 84 include the wires from a source of electricity and the wires that provide a connection to light source 64. The wires from the source of electricity would come through wire opening 94 and into electrical box 96. The wires connected to light source 64 would descend into electrical box 96 from receiver 52 and, more specifically, thru hole 95 in light chamber 62. Light fixture 10 facilitates installation and wiring for, when light housing 50 is placed over and on bracket 20 and before closing door 72 so that portion 78 extends beyond vertical plane 76, housing 50 stays in place without user intervention or assistance. Therefore, a user's hands are free to manipulate electrical wires 84 pulled down from electrical box 96 through access opening 98, as shown in FIG. 2*a*. Subsequent to making a connection, the user may then place electrical wires 84 up into electrical box 96, as shown in FIG. 2*b*, for storage.

In an alternative embodiment, access opening 98 may further be threaded so that, after placing electrical wires up into electrical box 96, an alternative illuminating source having a threaded attachment, such as a bolt, can be secured to access opening 98.

Bracket 20 and light housing 50 are, but need not be, made of the same material. Generally, metals are used for they metals are inexpensive, machinable, and strong. However, any sufficiently rigid and/or strong material suffices, such as wood, plastic, or ceramic. To facilitate manufacturing and, if welding is used to join the separable parts of bracket 20 and/or light housing 50, the same metals are used. However, in certain other embodiments, dissimilar metals are feasible.

Figure 5:
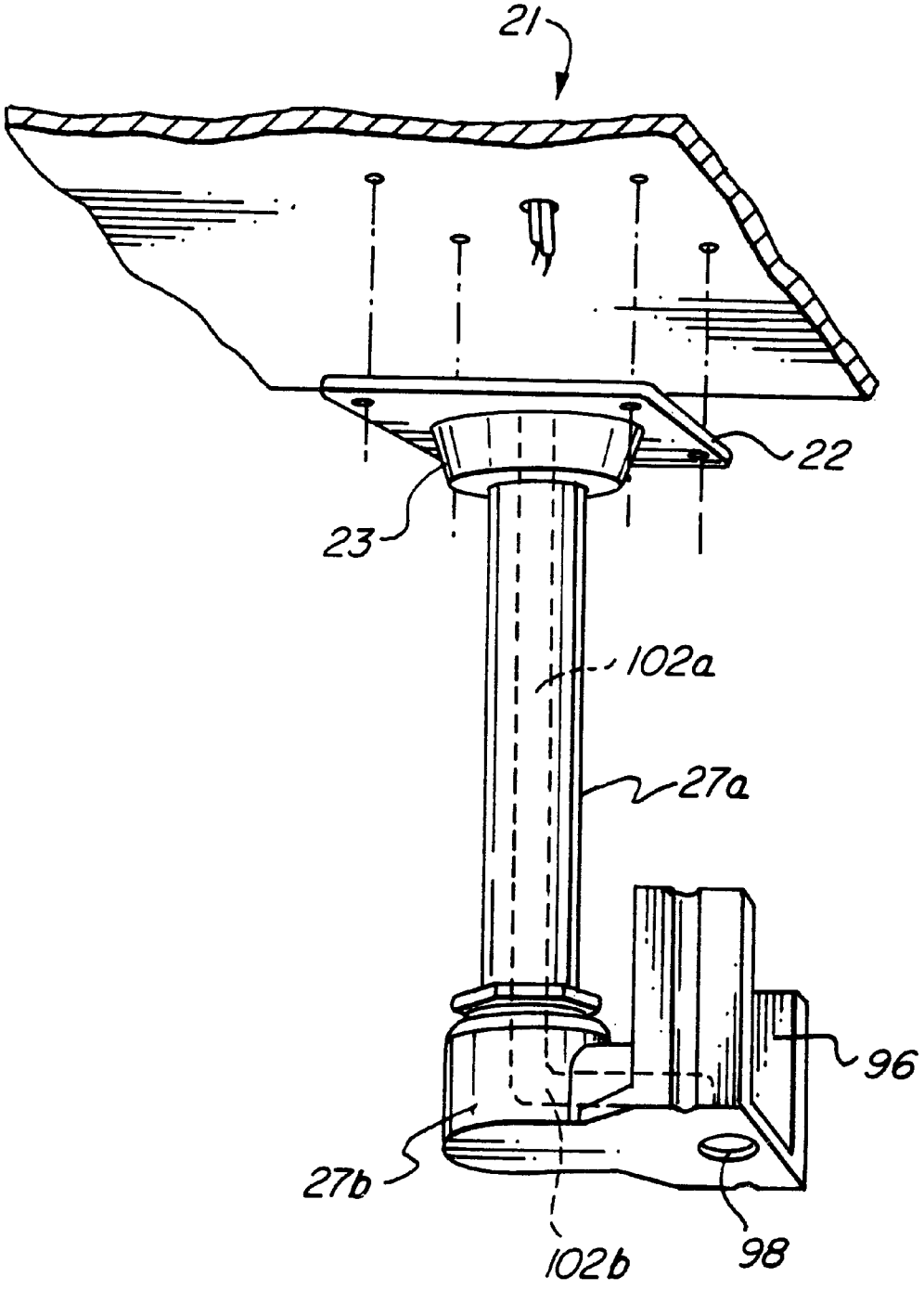
FIG. 5 depicts an alternative embodiment of the invention for mounting the light fixture from an overhang.

FIG. 5 depicts another embodiment of the invention showing bracket 21 mounted to a horizontal surface, such as an overhang of a building. This embodiment includes all the limitations as described under FIG. 1 and further includes an L shape extension having a vertical extension 27*a* and a horizontal extension 27b so that light housing 50, which functions in a generally horizontal position as shown in FIG. 1, can attach to horizontal extension 27*b*. Securing member 22 operates in the same manner as that described under FIG. 1 but secures bracket 21 to an overhang instead of a wall. Housing support 30, similar to the manner as described under FIG. 1, is placed at a cantilevered end of horizontal extension 27*b* and light housing 50 is placed thereon. Vertical and horizontal extensions 27*a* and 27*b* further include internal channels 102*a* and 102*b*, respectively, for carrying electrical wires from a source of electricity into electrical box 96.

Vertical extension 27*a* is connected to horizontal extension 27*b* using known or novel manners for connection, including welding, adhering, interference fitting, fastening, or any other methods for providing an L shape extension. As shown, a portion of vertical extension 27*a* is fitted inside a portion of horizontal section 27*b* until channels 102*a* and 102*b* are placed in contact with one another in an end-to-end fashion.

Vertical extension 27*a* is connected to securing member 22 using known or novel manners for connection, including welding, adhering, interference fitting, fastening, or any other methods for connecting vertical extension 27*a* to securing member 22. As shown in FIG. 5, an end of vertical extension 27*a* is fitted inside securing member receiver 23. A fastener or adhesion may further be used to secure vertical extension 27*a* inside securing member receiver 23. However, securing member receiver 23 is not required for bracket 21 to operate properly for vertical extension 27*a* may be connected directly to securing member 22.

Figure 6A:
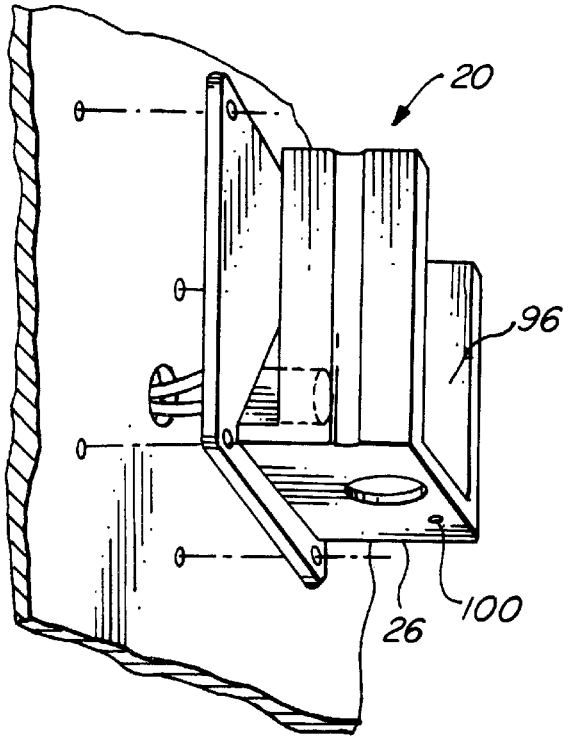
FIG. 6*a* depicts an alternative embodiment of the bracket providing a securing member for simultaneously securing the light housing to the bracket and for keeping the door in a closed position.
Figure 6B:
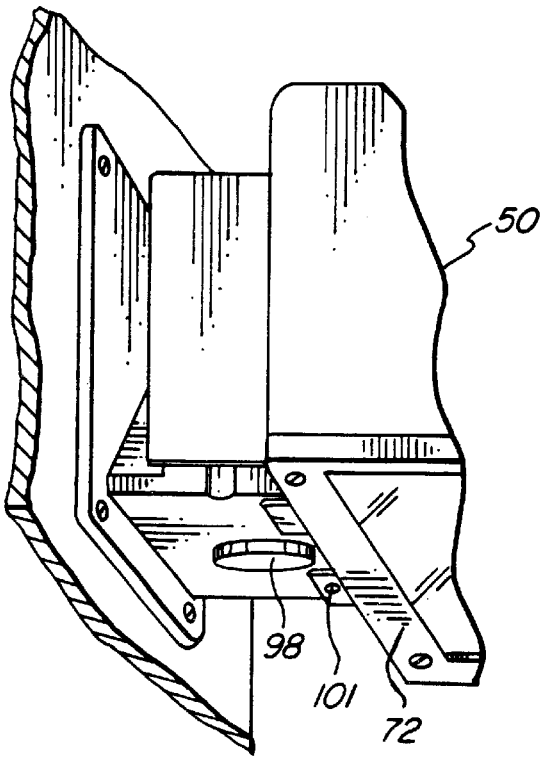
FIG. 6*b* depicts an alternative embodiment of the light fixture having a securing member for simultaneously securing the light housing to the bracket and for keeping the door in a closed position.

In an alternative embodiment depicted in FIG. 6*a* and 6*b*, bracket 20 may further include securing mechanism 100 for simultaneously securing door 72 in a closed position and securing light housing 50 to bracket 20. As shown in FIG. 6*a*, securing mechanism 100 is a threaded hole in extension 26. As shown in FIG. 6*b*, a through hole 101 in door 72 permits a fastener to fasten door 72 in a closed position and simultaneously also secures light housing 50 to bracket 20. In certain other embodiments, securing mechanism 100 is a clip for clipping door 72 in a closed position. In other embodiments, securing mechanism 100 is any type of securing mechanism for simultaneously holding door in a closed position and securing light housing 50 to bracket 20.

Figure 7A:
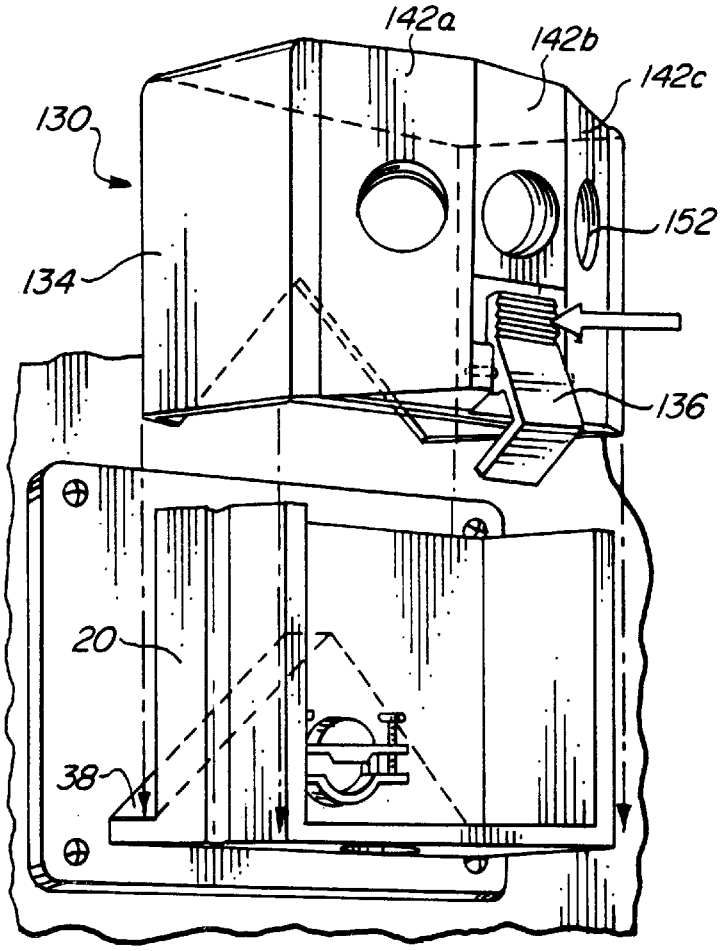
FIG. 7*a* depicts an isometric view of how an optional support for supporting an alternative light source is attached to the wall mounting bracket.
Figure 8A:
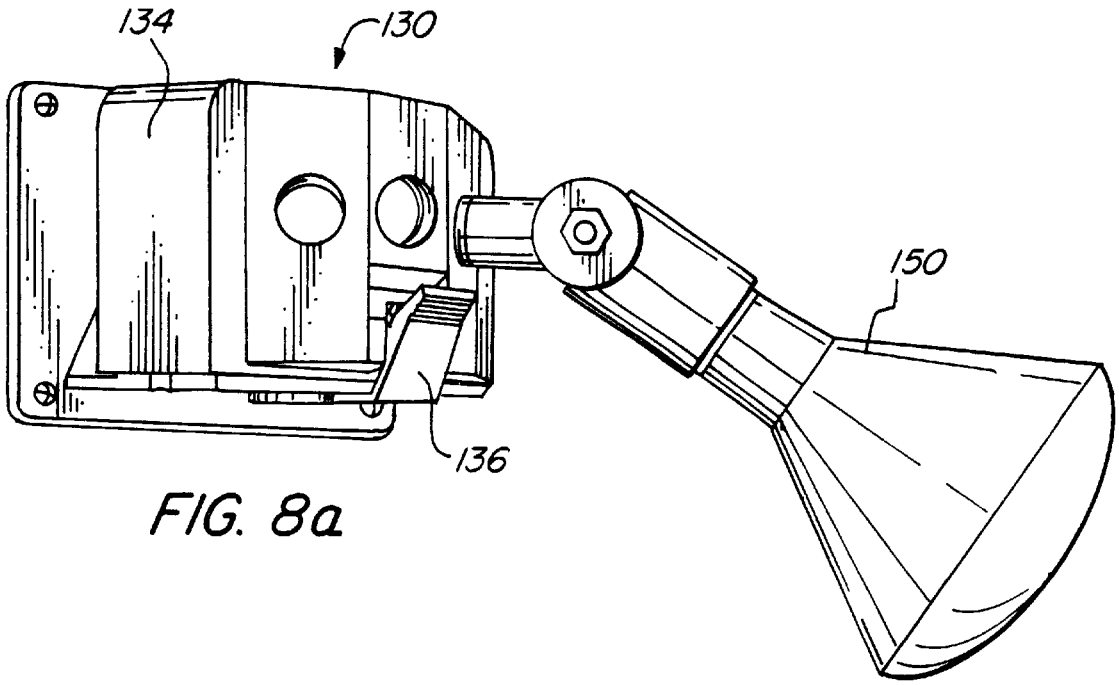
FIG. 8*a* depicts an isometric view of the alternative light source attached to the optional support.

FIGS. 7*a* and 8*a* depict a support 130 for an alternative light source 150. Both support 130 and alternative light source 150 are optional for the light source 10 depicted in FIG. 1 to function properly. Support 130 is only necessary for supporting the alternative light source 150, which may be a flood light or other source of light.

Support 130 includes receiver 134, whereby receiver 134 further includes a front side 142, left side, right side, and back side 148, thereby defining a receptacle for mating with and permitting housing support 30 of bracket 20 to slide inside receiver 134. Receiver 134 includes all of the limitations of receiver 52 as described and depicted under FIGS. 1, 4*a*, and 4*b* for mating with housing support 30 . Receiver 134 operates in the same manner as receiver 52 for sliding on top of housing support 30 of bracket 20. Receiver 134 further includes a top side for covering receiver 134 and preventing rain from entering support 130.

Figure 7B:
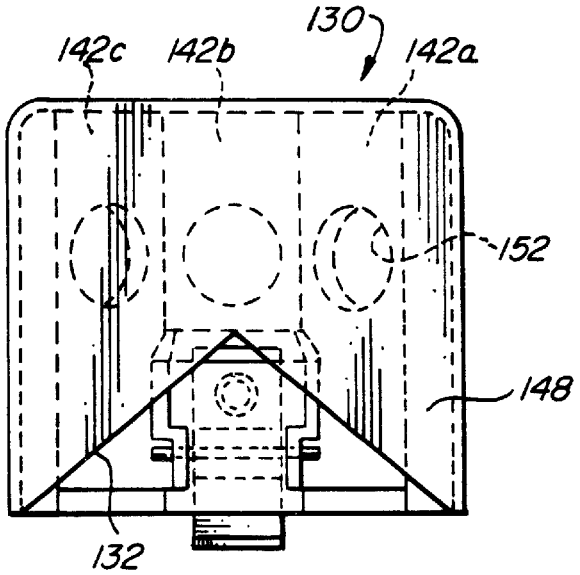
FIG. 7*b* depicts a rear view of the optional support for supporting the alternative light source.

As shown in FIGS. 7*a* and 7*b*, front side 142 further includes a left front side 142*a*, middle front side 142*b*, and right front side 142*c*, thereby defining a three sided front side 142 resembling a geometry similar to a bay window. The angles formed at the contact between left front side 142*a* and middle front side 142*b* or between middle front side 142*b* and right front side 142*c* is arbitrary and not germane to the invention of support 130. Each of left front side 142*a*, middle front side 142*b*, and right front side 142*c* further includes securing mechanism 152 for securing alternative light source 150 to support 130. Securing mechanism 152 is a threaded hole but, in other embodiments, may be any mechanism for securing alternative light source 150, such as an adhesive or fastener. Also, alternative light source 150 may be attached to either a left front side 142*a*, middle front side 142*b*, or right front side 142*c*. In addition, multiple alternative light sources 150 may be attached.

Figure 8B:
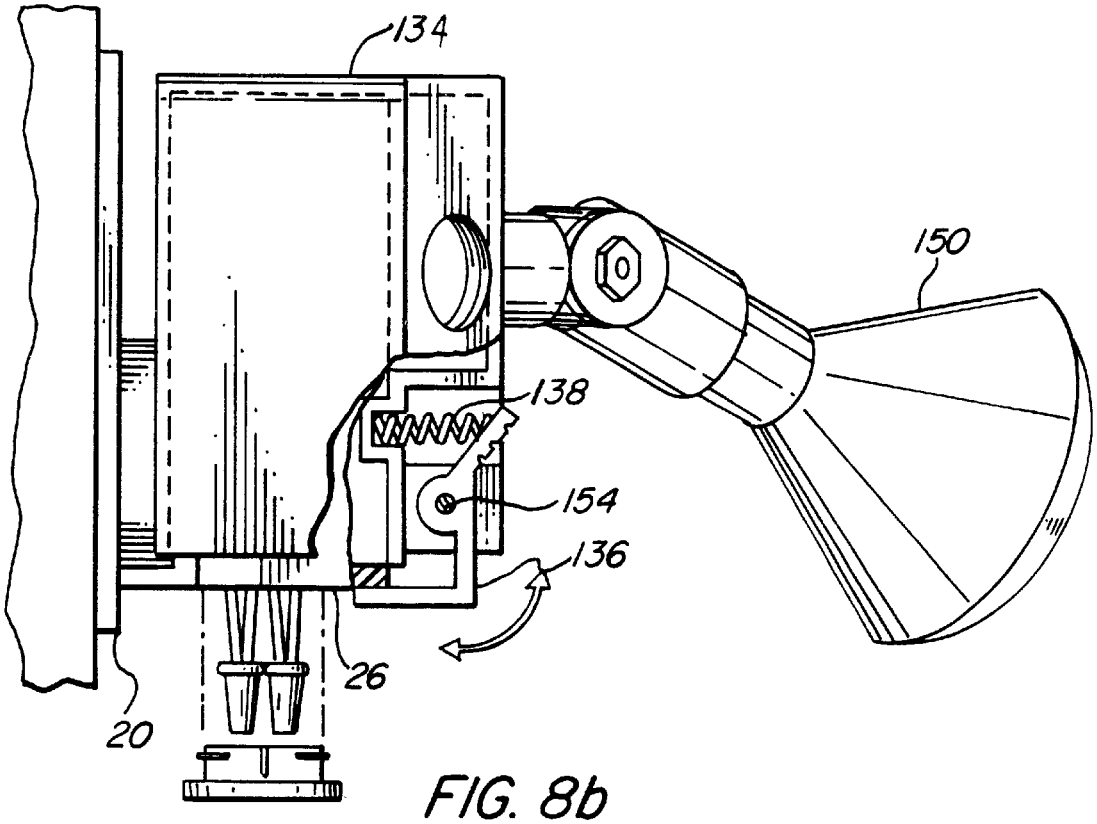
FIG. 8*b* depicts a left side view of the alternative light source attached to the optional support.

Support 130 also includes a locking mechanism 136 for securing support 130 to bracket 20. Locking mechanism 136 is more particularly depicted in FIG. 8*b* and is an L shaped lever that extends below and hooks under extension 26 of bracket 20. To secure or remove support 130, locking mechanism unhooks from below extension 26 by pivoting about pivot point 154, which may be a pin. Locking mechanism 130 further includes a spring 138 to spring load locking mechanism in a closed position, or hooked below extension 26. Compressing spring 138 causes locking mechanism 136 to pivot about pivot point 154.

In addition, support 130 further includes recess 132 in back side 148 for positioning support 130 on center with bracket 20. Recess 132 is triangular shaped to mate with locating member 38 of bracket 20 and support 130 is centered as locating member 38 is placed further within recess 132.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A light fixture, comprising:

a bracket for mounting a light housing to a fixed surface, including:

a securing member having a surface, said securing member being secured to the fixed surface;

an extension projecting from said surface of said securing member in a generally perpendicular direction and having a cantilevered end, said extension for spacing apart said securing member from the light housing;

a housing support placed at the cantilevered end of said extension and being spaced apart from said securing member and having a pair of inwardly tapered arms extending in a generally vertical direction upwardly from said cantilevered end for supporting the light housing when placed thereon; and a locating member extending in a generally vertical direction upwardly from said extension and placed adjacent to and in contact with said housing support for positioning the light housing;

wherein said light housing includes:

a receiver having a front side, a back side, a left side, and a right side, thereby defining a receptacle for placing said housing support inside said receiver;

a lighting chamber having a top surface, a back surface, and at least one side surface, thereby defining a covering for containing a light source;

a door for permitting access to said lighting chamber and having a window for permitting light to emanate from said lighting chamber through said window; and a portion of said door extending beyond a vertical plane of said housing support for preventing said housing from being removed from said bracket when said door is in the closed position.

2. The light fixture according to claim 1, further including a member placed between and in contact with both said cantilevered end and said housing support, said member extending in a generally perpendicular direction from said extension and having a second cantilevered end for placing said housing support thereon.

3. The light fixture according to claim 1, wherein said portion is a tab extending from an edge of said door.

4. The light fixture according to claim 1, whereby said extension is L shaped.

5. The light fixture according to claim 1, whereby said extension is a rod.

6. The light fixture according to claim 1, wherein said housing further including a recess to mate with said locating member.

7. The light fixture according to claim 1, wherein said locating member is triangular shaped.

8. The light fixture according to claim 1, wherein said recess is triangular shaped.

9. The light fixture according to claim 1, further including a mechanism for securing said door in a closed position.

10. The light fixture according to claim 9, wherein said mechanism is a fastener.

11. The light fixture according to claim 9, wherein said mechanism is an adhesive.

12. The light fixture according to claim 1, wherein said receiver and said housing support form a snug fit.

13. The light fixture according to claim 1, wherein said extension is generally horizontal.

14. The light fixture according to claim 1, wherein said extension is generally vertical.

15. The light fixture according to claim 1, wherein said securing member further includes a plurality of apertures.

16. The light fixture according to claim 1, wherein said securing member is a flange.

17. The light fixture according to claim 1, wherein said bracket further includes a channel for containing electrical wires.

18. The light fixture according to claim 17, wherein said channel is a conduit.

19. The light fixture according to claim 1, wherein said window is an opening.

20. The light fixture according to claim 1, wherein said window is a transparent material.

21. The light fixture according to claim 1, wherein said door is hingedly connected to an edge of said light chamber.

* * * * *